US009534527B2

(12) United States Patent
Sakayori et al.

(10) Patent No.: US 9,534,527 B2
(45) Date of Patent: Jan. 3, 2017

(54) THERMOSTAT FAILURE DETECTION DEVICE AND THERMOSTAT FAILURE DETECTION METHOD

(71) Applicant: NISSAN MOTOR CO., LTD., Yokohama-shi, Kanagawa (JP)

(72) Inventors: Yousuke Sakayori, Kanagawa (JP); Takane Hayashi, Kanagawa (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 125 days.

(21) Appl. No.: 14/396,947

(22) PCT Filed: Apr. 18, 2013

(86) PCT No.: PCT/JP2013/061463

§ 371 (c)(1),
(2) Date: Oct. 24, 2014

(87) PCT Pub. No.: WO2013/168529

PCT Pub. Date: Nov. 14, 2013

(65) Prior Publication Data

US 2015/0088364 A1 Mar. 26, 2015

(30) Foreign Application Priority Data

May 11, 2012 (JP) ..... 2012-109625

(51) Int. Cl.
*F01P 11/16* (2006.01)
*F01P 7/10* (2006.01)

(52) U.S. Cl.
CPC *F01P 11/16* (2013.01); *F01P 7/10* (2013.01); *F01P 2025/08* (2013.01);
(Continued)

(58) Field of Classification Search
CPC . F01P 2025/32; F01P 2025/08; F01P 2031/00; F01P 2060/08; F01P 7/16; F01P 2025/66; F01P 2025/34; F01P 11/16
(Continued)

(56) References Cited

U.S. PATENT DOCUMENTS

2012/0106590 A1* 5/2012 Suzuki ..... F01P 7/165 374/1

FOREIGN PATENT DOCUMENTS

WO WO 2011/039591 A1 4/2011

* cited by examiner

*Primary Examiner* — Mussa A Shaawat
*Assistant Examiner* — Abdhesh Jha
(74) *Attorney, Agent, or Firm* — Drinker Biddle & Reath LLP

(57) ABSTRACT

A thermostat failure detection device sequentially calculates a normal-time minimum water temperature on an assumption that a thermostat is normal and an internal combustion engine is operated in a state where the engine water temperature is less likely to rise, sequentially calculates a failure-time maximum water temperature on an assumption that the thermostat is in a stuck-open failure state and the internal combustion engine is operated in a state where the engine water temperature is likely to rise, determines the failure of the thermostat if the engine water temperature is lower than the normal-time minimum water temperature, determines the normality of the thermostat if the engine water temperature is higher than the failure-time maximum water temperature, and determines neither the normality nor the failure if the engine water temperature is between the normal-time minimum water temperature and the failure-time maximum water temperature.

3 Claims, 8 Drawing Sheets

(52) U.S. Cl.
CPC ..... *F01P 2025/13* (2013.01); *F01P 2025/32* (2013.01); *F01P 2025/62* (2013.01); *F01P 2025/64* (2013.01); *F01P 2025/66* (2013.01); *F01P 2031/32* (2013.01)

(58) Field of Classification Search
USPC ..... 236/34, 35, 93 R, 93 A; 701/29.7
See application file for complete search history.

THERMOSTAT FAILURE DETECTION DEVICE AND THERMOSTAT FAILURE DETECTION METHOD

TECHNICAL FIELD

This invention relates to a device and a method for detecting a failure of a thermostat provided in a cooling water flow passage of an internal combustion engine system.

BACKGROUND ART

A thermostat is provided in a cooling water flow passage of an internal combustion engine system. The thermostat closes a water passage to a radiator when an engine is cold. By doing so, cooling water is not circulated to the radiator. As a result, the warm-up of the engine is promoted. When the temperature of the cooling water reaches a preset valve opening temperature of the thermostat, the thermostat adjusts a flow rate of the cooling water to the radiator by opening the water passage to the radiator. As a result, the cooling water is maintained at a suitable temperature.

If the thermostat breaks down, a control as described above cannot be executed. Accordingly, JP2004-316638A proposes a technique for determining a failure of a thermostat. In this JP2004-316638A, the failure of the thermostat is determined if a detected engine water temperature is lower than a reference determination temperature calculated in consideration of the influence of traveling wind.

SUMMARY OF INVENTION

However, the present inventors found out a possibility of erroneous determination depending on an applied vehicle even if the conventional technique described above was used.

The present invention was developed in view of such a conventional problem. The present invention aims to provide a thermostat failure detection device and a thermostat failure detection method capable of accurately detecting a failure of a thermostat.

One embodiment of a thermostat failure detection device according to the present invention is a device for detecting a failure of a thermostat provided in a cooling water flow passage of an internal combustion engine system. This device includes a normal-time minimum water temperature calculator for sequentially calculating an engine water temperature, the engine water temperature is referred to as a "normal-time minimum water temperature" hereinafter, on an assumption that the thermostat is normal and an internal combustion engine is operated in a state where the engine water temperature is less likely to rise, and a failure-time maximum water temperature calculator for sequentially calculating the engine water temperature, the engine water temperature is referred to as a "failure-time maximum water temperature" hereinafter, on an assumption that the thermostat is in a stuck-open failure state and the internal combustion engine is operated in a state where the engine water temperature is likely to rise. The device further includes a determiner for determining the failure of the thermostat if the engine water temperature is lower than the normal-time minimum water temperature, determining the normality of the thermostat if the engine water temperature is higher than the failure-time maximum water temperature and determining neither the normality nor the failure if the engine water temperature is between the normal-time minimum water temperature and the failure-time maximum water temperature.

An embodiment and advantages of the present invention are described in detail below along with the accompanying drawings.

DESCRIPTION OF EMBODIMENT

Figure 1:
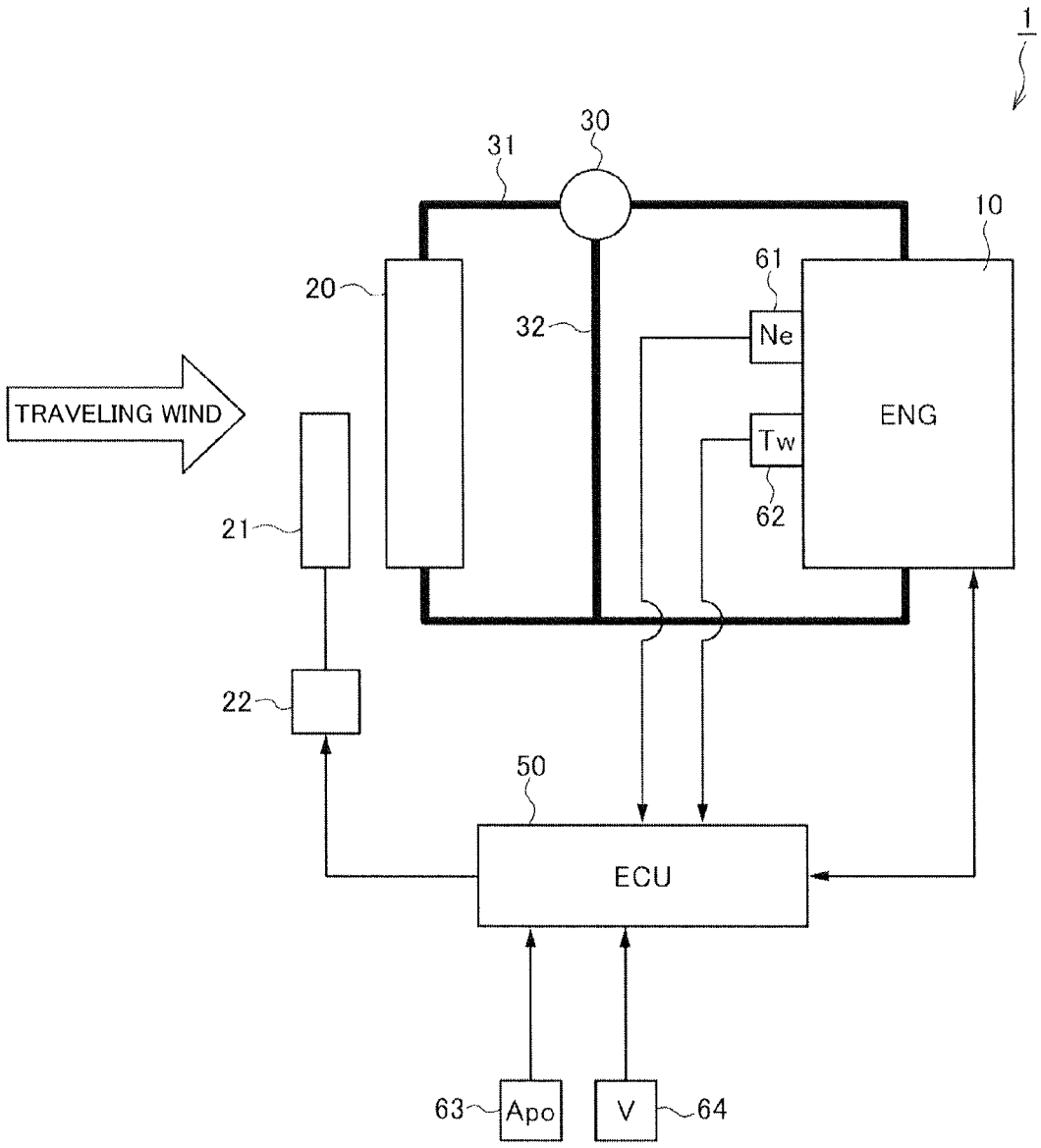
FIG. 1 is a diagram showing an internal combustion engine system to which a thermostat failure detection device and a thermostat failure detection method according to one embodiment of the present invention are applicable.

FIG. 1 is a diagram showing an internal combustion engine system to which a thermostat failure detection device and a thermostat failure detection method according to one embodiment of the present invention are applicable.

This internal combustion engine system 1 includes an internal combustion engine 10, a radiator 20 and a thermostat 30.

A rotation speed of the internal combustion engine 10 is detected by a rotation speed sensor 61. The temperature of cooling water of the internal combustion engine 10 is detected by a water temperature sensor 62.

The radiator 20 is a heat exchanger for radiating heat from the cooling water into the atmosphere. The radiator 20 is connected to the internal combustion engine 10 via a cooling water flow passage 31. A radiator shutter 21 is disposed before the radiator 20. The radiator shutter 21 increases and decreases the amount of ventilation to the radiator. If the amount of ventilation is large, the amount of heat radiation from the radiator 20 is large. In such a state, an engine water temperature is less likely to rise. If the amount of ventilation is small, the amount of heat radiation from the radiator 20 is small. In such a state, the engine water temperature is likely to rise. An opening of the radiator shutter 21 is adjusted by an actuator 22.

The thermostat 30 adjusts an opening according to the temperature of the cooling water. If the temperature of the cooling water is low, the thermostat 30 is closed. Then, the cooling water flows in a bypass flow passage 32 and does not flow into the radiator 20. As a result, the warm-up of the engine is promoted. When the temperature of the cooling water reaches a preset valve opening temperature of the thermostat 30, the thermostat 30 adjusts a flow rate of the cooling water to the radiator 20 by opening the water passage to the radiator 20. As a result, the cooling water is maintained at a suitable temperature.

The operation of the internal combustion engine 10 and the actuator 22 is controlled by an engine control unit 50. The engine control unit 50 controls a throttle opening and an ignition timing of the internal combustion engine 10, the amount of actuation of the actuator 22 and the like based on signals such as from the rotation speed sensor 61, the water temperature sensor 62, an accelerator pedal operation amount sensor 63 and a vehicle speed sensor 64.

Figure 4A:
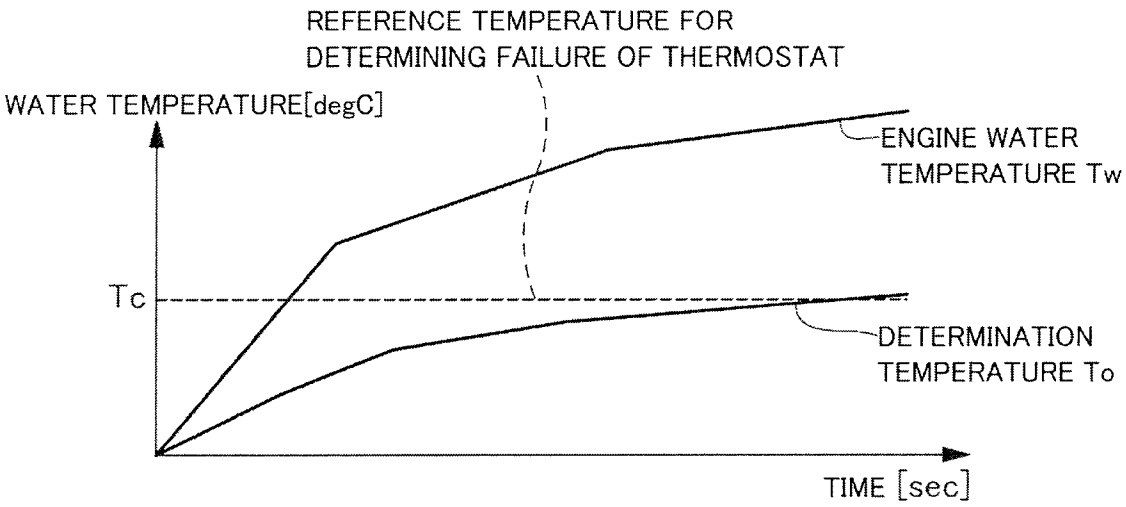
FIG. 4A is a graph showing a problem sought to be solved by the present application.
Figure 4B:
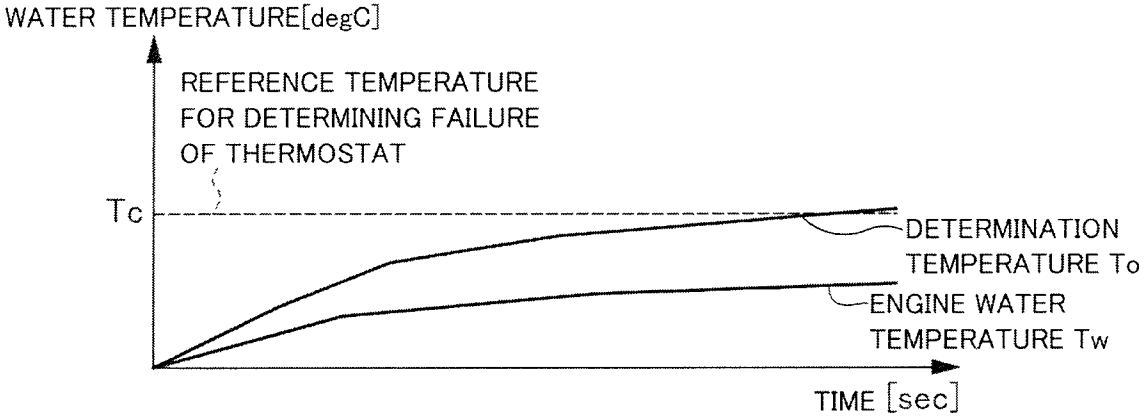
FIG. 4B is a graph showing the problem sought to be solved by the present application.
Figure 4C:
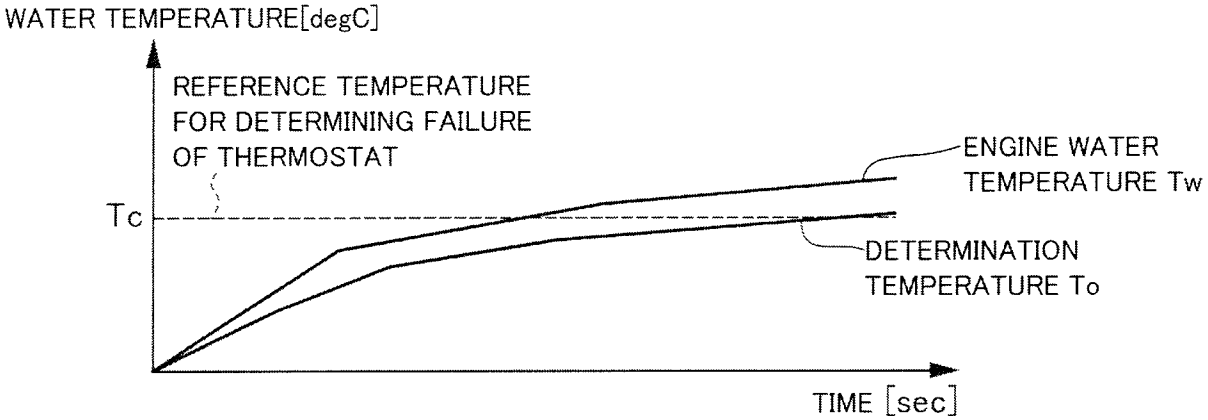
FIG. 4C is a graph showing the problem sought to be solved by the present application.

Here, a problem sought to be solved by the present application is described with reference to FIGS. 4A to 4C to facilitate the understanding of the present embodiment. It should be noted that FIG. 4A is a graph showing a change in the engine water temperature when the thermostat is normal. FIG. 4B is a graph showing a change in the engine water temperature when the thermostat fails. FIG. 4C is a graph showing a change in the engine water temperature when the thermostat fails, but the failure cannot be detected.

If the thermostat is normal, it is closed up to the valve opening temperature and the cooling water does not flow into the radiator. Thus, as shown in FIG. 4A, the engine water temperature Tw quickly rises. Conventionally, a determination temperature T0 has been sequentially calculated and the thermostat has been determined to be normal if the current engine water temperature Tw is above the determination temperature T0 as shown in FIG. 4A.

If the thermostat fails (stuck-open failure), the thermostat cannot be fully closed. Thus, the cooling water flows into the radiator even if the temperature of the cooling water is low. Then, as shown in FIG. 4B, the engine water temperature Tw is less likely to rise. Conventionally, the thermostat has been regarded to have failed if the current engine water temperature Tw is below the determination temperature T0 as in FIG. 4B.

The present inventors are developing an internal combustion engine system including a radiator shutter disposed before a radiator. If the radiator shutter is fully closed in such a case, the engine water temperature Tw may rise and the current engine water temperature Tw may exceed the determination temperature T0 as shown in FIG. 4C even if the thermostat fails and the cooling water flows into the radiator. In such a case, it may be erroneously determined that the thermostat is normal although having actually a failure.

To solve such a problem, a failure of the thermostat is detected as follows in the present embodiment.

Figure 2:
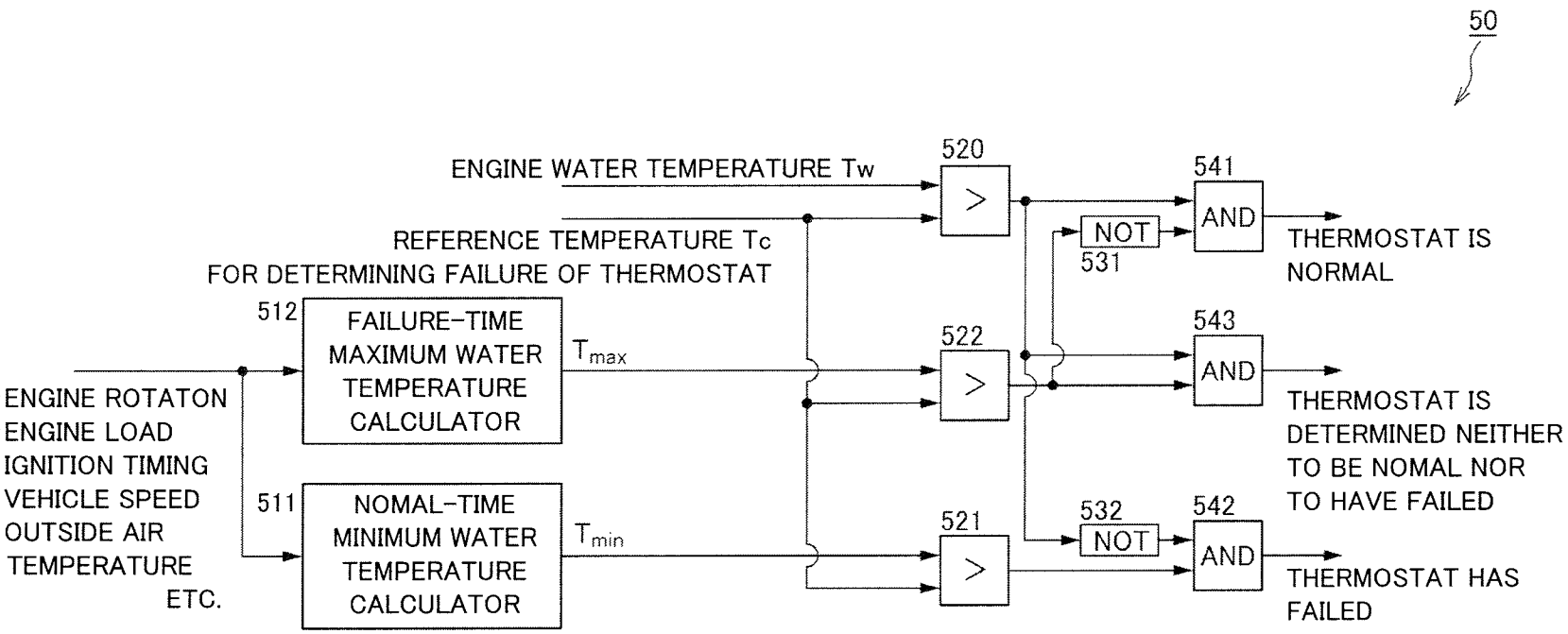
FIG. 2 is a block diagram showing functions of an engine control unit, particularly those relating to thermostat failure detection.

FIG. 2 shows functions of the engine control unit, particularly those relating to thermostat failure detection in the form of a block diagram.

It should be noted that each block shown in the block diagram shows each function of the control unit as a virtual unit and each block does not mean physical presence. Further, this engine control unit repeatedly executes this control block in a predetermined very short time (e.g. 10 milliseconds) cycle.

The control unit 50 includes a normal-time minimum water temperature calculator 511, a failure-time maximum water temperature calculator 512, an engine water temperature comparator 520, a normal-time minimum water temperature comparator 521, a failure-time maximum water temperature comparator 522, a negator 531, a negator 532, a normality determiner 541, a failure determiner 542 and an intermediate determiner 543.

The normal-time minimum water temperature calculator 511 sequentially calculates the engine water temperature, the engine water temperature is referred to as a "normal-time minimum water temperature" hereinafter, on an assumption that the thermostat 30 is normal, but the internal combustion engine 10 is operated in a state where the engine water temperature is least likely to rise based on engine operating conditions such as an engine rotation speed, an engine load, an ignition timing, a vehicle speed and an outside air temperature. Specifically, a correlation map between the engine water temperature and the engine operating conditions in the state where the thermostat 30 is normal, but the engine water temperature is least likely to rise may be, for example, prepared in advance, and the normal-time minimum water temperature may be calculated based on that map. It should be noted that the state where the engine water temperature is least likely to rise is, for example, a state where the radiator shutter 21 is fully open.

The failure-time maximum water temperature calculator 512 sequentially calculates the engine water temperature, the engine water temperature is referred to as a "failure-time maximum water temperature" hereinafter, on an assumption that the thermostat 30 is in a stuck-open failure state, whereas the internal combustion engine 10 is operated in a state where the engine water temperature is most likely to rise based on the engine operating conditions such as the engine rotation speed, the engine load, the ignition timing, the vehicle speed and the outside air temperature. Specifically, a correlation map between the engine water temperature and the engine operating conditions in the state where the thermostat 30 is in the stuck-open failure state, whereas the engine water temperature is most likely to rise may be, for example, prepared in advance, and the failure-time maximum water temperature may be calculated based on that map. It should be noted that the state where the engine water temperature is most likely to rise is, for example, a state where the radiator shutter 21 is fully closed.

The engine water temperature comparator 520 compares the engine water temperature Tw detected by the water temperature sensor 62 and a reference temperature Tc for determining the failure of the thermostat. If the engine water temperature Tw is higher than the reference temperature Tc, the engine water temperature comparator 520 outputs a signal. This signal is input to the negator 531, the normality determiner 541 and the intermediate determiner 543. Unless the engine water temperature Tw is higher than the reference temperature Tc, the engine water temperature comparator 520 outputs no signal, but the negator 531 outputs a signal. This signal is input to the failure determiner 542.

The normal-time minimum water temperature comparator 521 compares a normal-time minimum water temperature Tmin and the reference temperature Tc. If the normal-time minimum water temperature Tmin is higher than the reference temperature Tc, the normal-time minimum water temperature comparator 521 outputs a signal. This signal is input to the failure determiner 542.

The failure-time maximum water temperature comparator 522 compares a failure-time maximum water temperature Tmax and the reference temperature Tc. If the failure-time maximum water temperature Tmax is higher than the reference temperature Tc, the failure-time maximum water temperature comparator 522 outputs a signal. This signal is input to the negator 532 and the intermediate determiner 543. Unless the failure-time maximum water temperature Tmax is higher than the reference temperature Tc, the failure-time maximum water temperature comparator 522 outputs no signal, but the negator 532 outputs a signal. This signal is input to the normality determiner 541.

The normality determiner 541 determines the normality of the thermostat when receiving signals from the engine water temperature comparator 520 and the negator 532. Specifically, the normality determiner 541 determines the normality of the thermostat when the engine water temperature Tw is higher than the reference temperature Tc, but the failure-time maximum water temperature Tmax is not higher than the reference temperature Tc.

The failure determiner 542 determines the failure of the thermostat when receiving signals from the normal-time minimum water temperature comparator 521 and the negator 531. Specifically, the failure determiner 542 determines the failure of the thermostat when the engine water temperature Tw is not higher than the reference temperature Tc, but the normal-time minimum water temperature Tmin is higher than the reference temperature Tc.

The intermediate determiner 543 determines an intermediate state and determines neither the normality nor the failure when receiving signals from the engine water temperature comparator 520 and the failure-time maximum water temperature comparator 522. Specifically, the intermediate determiner 543 determines the intermediate state and determines neither the normality nor the failure when the engine water temperature Tw is higher than the reference temperature Tc and the failure-time maximum water temperature Tmax is higher than the reference temperature Tc.

Figure 3A:
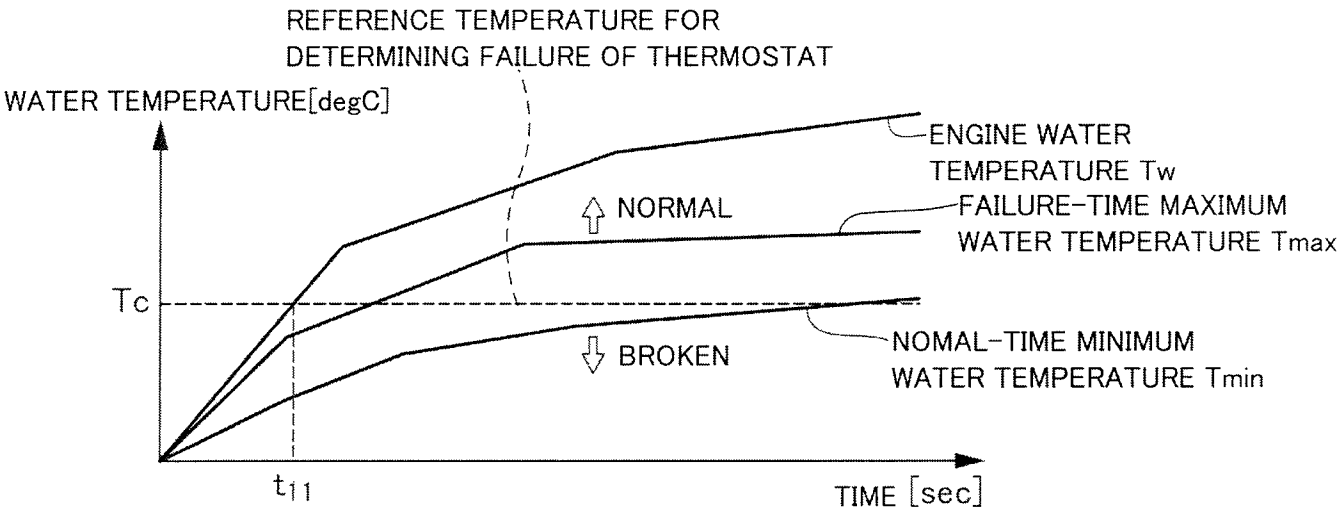
FIG. 3A is a graph showing functions and effects of the embodiment according to the present invention.
Figure 3B:
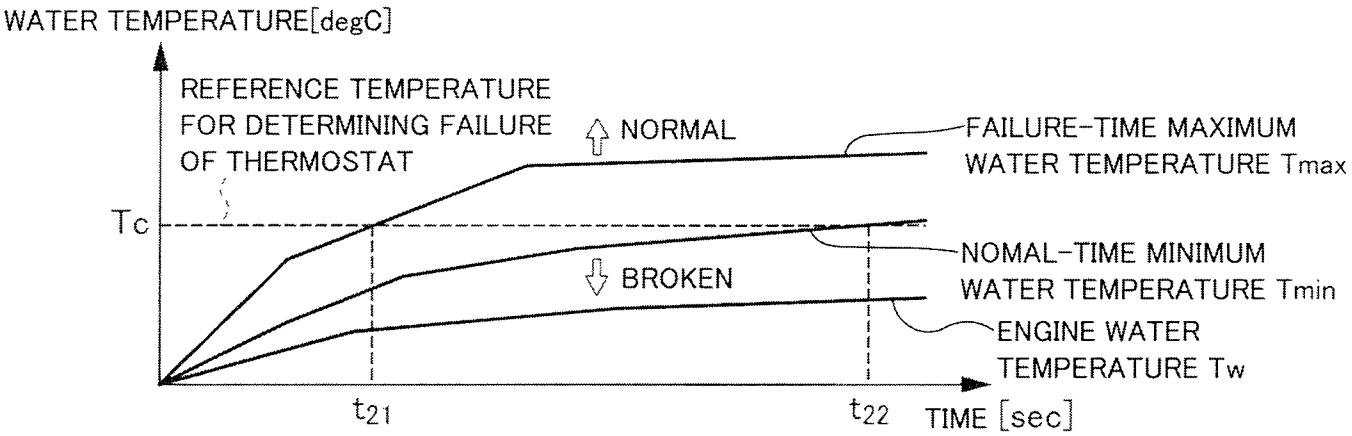
FIG. 3B is a graph showing the functions and effects of the embodiment according to the present invention.
Figure 3C:
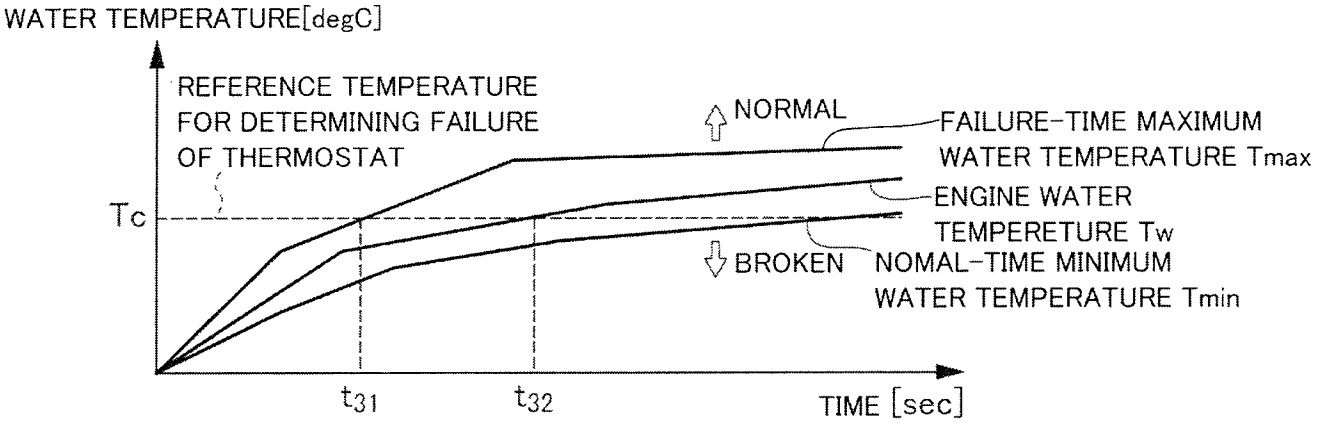
FIG. 3C is a graph showing the functions and effects of the embodiment according to the present invention.

FIGS. 3A to 3C are graphs showing functions and effects of the present embodiment. It should be noted that FIG. 3A is a graph showing a change in the engine water temperature when the thermostat is normal. FIG. 3B is a graph showing a change in the engine water temperature when the thermostat fails. FIG. 3C is a graph showing a change in the engine water temperature when the thermostat is determined to be in an intermediate state.

When the control block shown in FIG. 2 is executed, the following functions and effects are achieved.

(Normality Determination)

If the thermostat 30 is normal, the thermostat 30 is closed up to the valve opening temperature and the cooling water does not flow into the radiator 20. Thus, the engine water temperature quickly rises as shown in FIG. 3A.

Until time t11, the engine water temperature Tw, the normal-time minimum water temperature Tmin and the failure-time maximum water temperature Tmax are all lower than the reference temperature Tc. In such a state, the engine water temperature comparator 520, the normal-time minimum water temperature comparator 521 and the failure-time maximum water temperature comparator 522 output no signals, but the negators 531, 532 output signals. In this state, nothing is determined.

After time t11, the engine water temperature Tw becomes higher than the reference temperature Tc. Accordingly, the engine water temperature comparator 520 outputs a signal and the negator 531 no longer outputs the signal. In this state, the normality determiner 541 outputs a signal and the normality of the thermostat is determined.

(Failure Determination)

If the thermostat 30 fails (stuck-open failure), the thermostat 30 cannot be fully closed. Thus, the cooling water flows into the radiator 20 even if the temperature of the cooling water is low. Then, the engine water temperature is less likely to rise as shown in FIG. 3B.

Until time t21, the engine water temperature Tw, the normal-time minimum water temperature Tmin and the failure-time maximum water temperature Tmax are all lower than the reference temperature Tc. In such a state, the engine water temperature comparator 520, the normal-time minimum water temperature comparator 521 and the failure-time maximum water temperature comparator 522 output no signals, but the negators 531, 532 output signals. In this state, nothing is determined.

After time t21, the failure-time maximum water temperature Tmax becomes higher than the reference temperature Tc. Accordingly, the failure-time maximum water temperature comparator 522 outputs a signal and the negator 532 no longer outputs the signal. Also in this state, nothing is determined.

After time t22, the normal-time minimum water temperature Tmin becomes higher than the reference temperature Tc. Accordingly, the normal-time minimum water temperature comparator 521 outputs a signal. In this state, the failure determiner 542 outputs a signal and the failure of the thermostat 30 is determined.

(Intermediate Determination)

When the radiator shutter 21 is closed, the engine water temperature may become higher than the normal-time minimum water temperature as shown in FIG. 3C even if the thermostat 30 fails (stuck-open failure). In such a case, the following process is performed.

Until time t31, the engine water temperature Tw, the normal-time minimum water temperature Tmin and the failure-time maximum water temperature Tmax are all lower than the reference temperature Tc. In such a state, the engine water temperature comparator 520, the normal-time minimum water temperature comparator 521 and the failure-time maximum water temperature comparator 522 output no signals, but the negators 531, 532 output signals. In this state, nothing is determined.

After time t31, the failure-time maximum water temperature Tmax becomes higher than the reference temperature Tc. Accordingly, the failure-time maximum water temperature comparator 522 outputs a signal and the negator 532 no longer outputs the signal. Also in this state, nothing is determined.

After time t32, the engine water temperature Tw becomes higher than the reference temperature Tc. Accordingly, the engine water temperature comparator 520 outputs a signal and the negator 531 no longer outputs the signal. In this state, the intermediate determiner 543 outputs a signal, the intermediate state of the thermostat 30 is determined and neither the normality nor the failure is determined.

If the thermostat provided in the cooling water flow passage of the internal combustion engine system breaks down, it becomes difficult to optimize the engine water temperature. Accordingly, techniques for determining a failure of a thermostat have been proposed. However, the present inventors found out a possibility of erroneous determination depending on an applied vehicle even if such techniques were used. For example, in the internal combustion engine system including the radiator shutter 21 disposed before the radiator 20, if the radiator shutter 21 is fully closed, there has been a possibility that the engine water temperature rises to cause erroneous determination even if the cooling water flows into the radiator 20 due to the failure of the thermostat 30.

Contrary to this, in the present embodiment, the engine water temperature on the assumption that the thermostat 30 is in the stuck-open failure state, whereas the internal combustion engine 10 is operated in the state where the engine water temperature is most likely to rise (failure-time maximum water temperature) is sequentially calculated. If the engine water temperature is higher than the failure-time maximum water temperature, the normality of the thermostat 30 is determined. Further, the engine water temperature on the assumption that the thermostat 30 is normal, but the internal combustion engine 10 is operated in the state where the engine water temperature is least likely to rise (normal-time minimum water temperature) is sequentially calculated.

If the engine water temperature is lower than the normal-time minimum water temperature, the failure of the thermostat 30 is determined. If the engine water temperature is between the failure-time maximum water temperature and the normal-time minimum water temperature, the intermediate state is determined and neither the normality nor the failure is determined. By doing so, erroneous determination on the failure of the thermostat 30 can be prevented.

Although the embodiment of the present invention has been described above, the above embodiment is merely an illustration of one application example of the present invention, and the technical scope of the present invention is not limited to the specific configuration of the above embodiment.

The present application claims priority of Japanese Patent Application No. 2012-109625 filed with the Japan Patent Office on May 11, 2012, all the contents of which are hereby incorporated into this specification by reference.

What is claimed is:

1. A thermostat failure detection device for detecting a failure of a thermostat provided in a cooling water flow passage of an internal combustion engine system, comprising:

a normal-time minimum water temperature calculator for sequentially calculating an engine water temperature, the engine water temperature is referred to as a "normal-time minimum water temperature" hereinafter, on an assumption that the thermostat is normal and an internal combustion engine is operated in a state where a radiator shutter is fully open;

a failure-time maximum water temperature calculator for sequentially calculating the engine water temperature, the engine water temperature is referred to as a "failure-time maximum water temperature" hereinafter, on an assumption that the thermostat is in a stuck-open failure state and the internal combustion engine is operated in a state where the radiator shutter is fully closed; and a determiner for determining the failure of the thermostat if the engine water temperature is lower than the normal-time minimum water temperature, determining the normality of the thermostat if the engine water temperature is higher than the failure-time maximum water temperature and determining that the engine water temperature is not within the range that enables failure and normality determination if the engine water temperature is between the normal-time minimum water temperature and the failure-time maximum water temperature.

2. The thermostat failure detection device according to claim 1, wherein:

the determiner determines the normality of the thermostat if the failure-time maximum water temperature is lower than a reference temperature when the engine water temperature reaches the reference temperature, determines the failure of the thermostat if the engine water temperature is lower than the reference temperature when the normal-time minimum water temperature reaches the reference temperature and determines neither the normality nor the failure if the failure-time maximum water temperature is higher than the reference temperature and the normal-time minimum water temperature is lower than the reference temperature when the engine water temperature reaches the reference temperature.

3. A thermostat failure detection method for detecting a failure of a thermostat provided in a cooling water flow passage of an internal combustion engine system, comprising:

a normal-time minimum water temperature calculation step of sequentially calculating an engine water temperature, the engine water temperature is referred to as a "normal-time minimum water temperature" hereinafter, on an assumption that the thermostat is normal and an internal combustion engine is operated in a state where a radiator shutter is fully open;

a failure-time maximum water temperature calculation step of sequentially calculating the engine water temperature, the engine water temperature is referred to as a "failure-time maximum water temperature" hereinafter, on an assumption that the thermostat is in a stuck-open failure state and the internal combustion engine is operated in a state where the radiator shutter is fully closed; and a determination step of determining the failure of the thermostat if the engine water temperature is lower than the normal-time minimum water temperature, determining the normality of the thermostat if the engine water temperature is higher than the failure-time maximum water temperature and determining that the engine water temperature is not within the rang that enables failure and normality determination if the engine water temperature is between the normal-time minimum water temperature and the failure-time maximum water temperature.

* * * * *